United States Patent [19]

Schörling

[11] Patent Number: 4,458,882

[45] Date of Patent: Jul. 10, 1984

[54] WINCH

[75] Inventor: Stefan H. G. Schörling, Nacka, Sweden

[73] Assignee: Atlas Copco Aktiebolag, Nacka, Sweden

[21] Appl. No.: 370,176

[22] Filed: Apr. 21, 1982

[30] Foreign Application Priority Data

May 18, 1981 [SE] Sweden ..... 8103115

[51] Int. Cl.[3] ..... B66D 1/00; B66D 1/22

[52] U.S. Cl. ..... 254/332; 254/344; 254/360

[58] Field of Search ..... 254/329, 332, 344, 360, 254/901, 288; 242/68.3

[56] References Cited

U.S. PATENT DOCUMENTS

| | | | |
|---|---|---|---|
| 2,846,984 | 8/1958 | Zwayer | 254/360 X |
| 2,891,767 | 6/1959 | Armington, Jr. | 254/344 |
| 3,116,892 | 1/1964 | Pickard | 254/344 X |
| 4,130,251 | 12/1978 | Findley | 242/84.1 X |
| 4,211,454 | 7/1980 | Mitchell et al. | 384/192 X |

FOREIGN PATENT DOCUMENTS

| | | |
|---|---|---|
| 142902 | 2/1981 | Denmark . |
| 381446 | 6/1972 | Sweden . |

*Primary Examiner*—Stuart S. Levy
*Assistant Examiner*—Katherine Jaekel
*Attorney, Agent, or Firm*—Frishauf, Holtz, Goodman & Woodward

[57] ABSTRACT

A winch includes a rotatable drum unit (11) for carrying a load hauling cable wound therearound. The drum unit (11) is rotated by a motor (25) connected to a gear assembly (41). The drum unit (11), motor (25), and gear assembly (41) are carried by a supporting structure including first and second stands (12, 13) arranged on each side of the drum unit (11). The first stand (12) comprises a hollow bearing body (26) mounted to a yielding member (56) of the stand (12). The bearing body extends into the drum unit (11) and has axially spaced external bearing means (31, 32) for journalling said drum unit (11). The bearing body (26) also includes means (29, 30, 49) for carrying said motor (25) and at least partly said gear assembly (41) which is located in the drum unit (11). The second stand (13) comprises a pendulum bearing (33) for cooperation with a trunnion (35) on the drum unit (11), said bearing (33) and yielding member (56) being adapted for maintaining a fixed mutual alignment between the motor (25), gear assembly, and drum unit (11) if the winch is installed on an uneven surface.

11 Claims, 7 Drawing Figures

WINCH

BACKGROUND OF THE INVENTION

This invention relates to a winch including a rotatable drum unit for carrying a load hauling cable wound therearound, a motor connected to a gear assembly for rotating said drum unit and a supporting structure with a first and a second stand being arranged on each side of the drum unit for carrying said drum unit, motor, and gear assembly.

Winches of the type mentioned above normally have the motor, gear assembly, and drum unit located in line one after the other. Such a design will, however, make the winches spacious and heavy and tends to put too heavy a load on one of the winch stands. Since winches of that kind often are installed on an uneven surface, they normally demand a firm heavy supporting structure or an articulated connection between one of the stands and the understructure for maintaining the alignment between said motor, gear assembly, and drum unit. Such a supporting structure or connection will, however, further increase the weight and manufacturing costs for the winch.

SUMMARY OF THE INVENTION

An object of the present invention is to provide a winch which is more compact and lighter than prior art winches but still having the same range of performance.

Another object is to provide a winch which can be mounted on an uneven or inclined surface without causing misalignment in the mutual positions of the motor, gear assembly, and drum unit.

According to the present invention, a winch comprises a rotatable drum unit for carrying a load hauling cable wound therearound, the drum unit having a trunnion at one end thereof; a motor; and a gear assembly coupled to the motor and to the drum unit for rotating the drum unit, the gear assembly being located in the drum unit; the drum unit, motor and gear assembly being substantially rigidly coupled together in fixed mutual alignment. A supporting structure is provided which is adapted to be placed on an external support, the supporting structure including first and second stands coupled to respective opposite sides of the drum unit for carrying the drum unit, the first and second stands being independently tiltable relative to each other and relative to the drum unit, such that the drum unit, motor and gear assembly are maintained in said fixed mutual alignment irrespective of unevenness of a surface of the external support on which the supporting structure is placed. The first stand comprises: a support member adapted to be placed on the external support; and yieldable means coupled between the drum unit and the support member for yielding to permit the support member to tilt relative to the drum unit. The second stand comprises a pendulum bearing for cooperation with the trunnion on the drum unit to permit tilting of the second stand relative to the drum unit. With this structure, the drum unit, motor and gear assembly are maintained in said mutual fixed alignment irrespective of tilting of the first and second stands relative to each other and relative to the drum unit.

DETAILED DESCRIPTION

Figure 1:
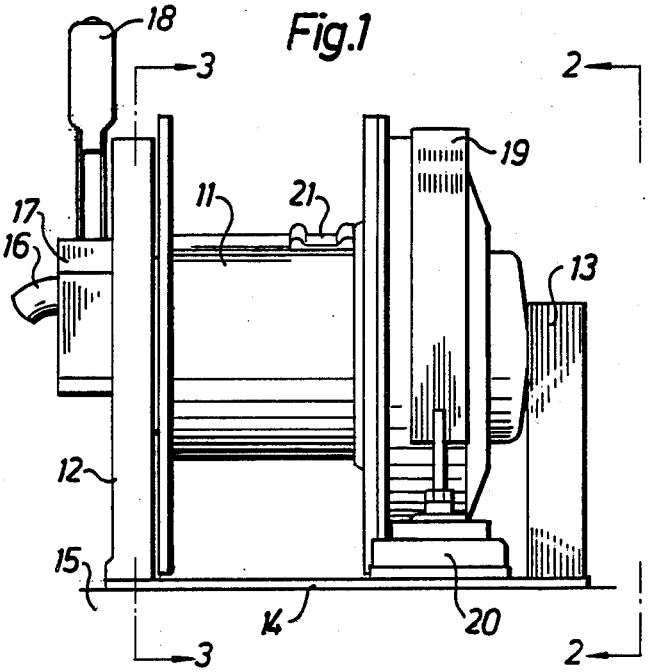
FIG. 1 is a side view of a winch according to the invention.
Figure 2:
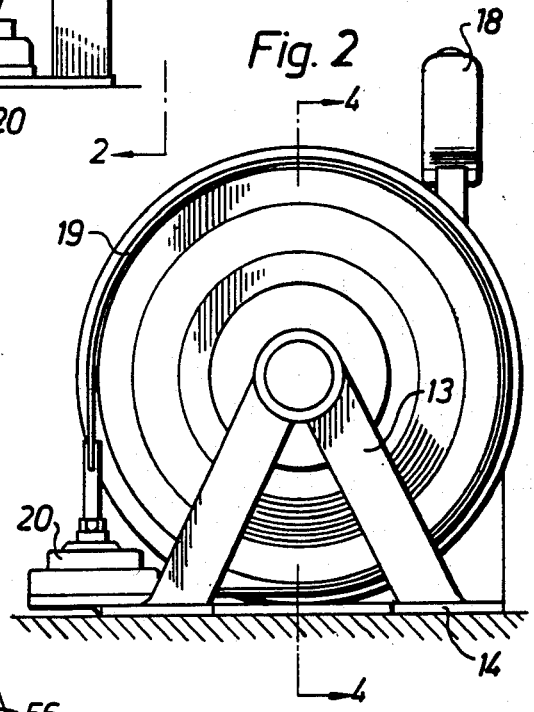
FIG. 2 is an end view seen as indicated by the line 2—2 in FIG. 1.

The winch shown in FIGS. 1-4 includes a rotatable drum unit 11 for carrying a not shown load hauling cable wound therearound. The drum unit 11 is carried by a supporting structure which includes a first stand 12, a second stand 13 and a base portion 14 on which said stands 12 and 13 are attached. The structure rests on an external support 15 for the winch.

The winch is driven by compressed air supplied through a hose 16 from a not shown source. The air is led to a control valve 17 which controls the rotation direction of the drum unit 11 and is manually operated by a lever 18. A strap brake 19 activates directly on the drum unit 11. The brake 19 is attached to the base portion 14 by a housing 20 including the breaking power generating means. A locking means 21 for attaching the cable is mounted on the drum unit 11.

The winch is powered by a vane-type air motor 25 (FIG. 4) arranged in a hollow preferably tube-formed bearing body 26. The bearing body 26 is mounted to the first stand 12 by a series of bolts 27 and provides the housing for the rotor part 28 of the motor 25 said rotor part 28 being journalled by bearings 29 and 30. Bearings 31 and 32 surround the bearing body 26. Bearings 31 and 32 are adapted for journalling the drum unit 11 in cooperation with a bearing 33 attached to the second stand 13. Said bearing 33 is put on a trunnion 35 integrated with the drum unit 11 and is a spherical roller bearing adapted to allow inclinations between the trunnion 35 and the second stand 13. The air motor 25 is supplied with compressed air from said control valve 17 and transfers the drive force via a drive shaft 40 to a gear assembly 41 located inside the drum unit 11. The gear assembly 41 is arranged as a two step planet gearing. The first step is taken by first gear wheels 42, one of three wheels shown, and a first gear ring 43 included in the drum unit 11. The second step is taken by second gear wheels 44, one of three shown and a second gear ring 45 also included in the drum unit 11.

The first and second gear wheels 42 and 44 are journalled on a first and a second planet carrier 46 and 47 respectively. Said first planet carrier 46 is journalled in a bearing 48 arranged between said two carriers 46 and 47 and said second planet carrier 47 is mounted to the bearing body 26 by bolts 49 of which only one is shown. The gear assembly 41 will operate as follows: The drive shaft 40 rotates the first gear wheels 42 which in turn rotate the first planet carrier 46. Said carrier 46 has a gear wheel 50 for rotating the second gear wheels 44 which finally rotate the drum unit 11.

Figure 3:
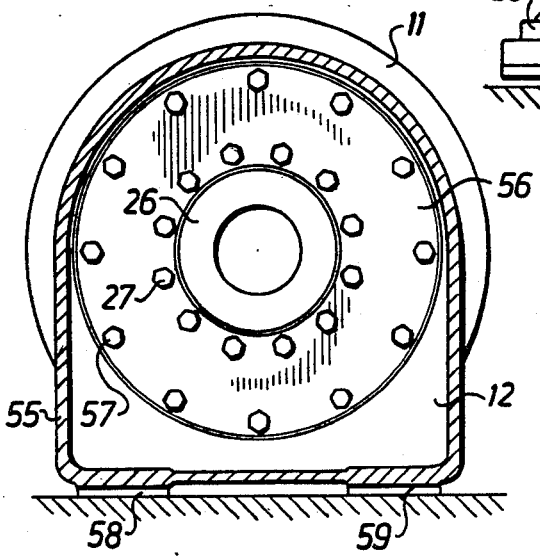
FIG. 3 is a cross section taken through the line 3—3 in FIG. 1.
Figure 4:
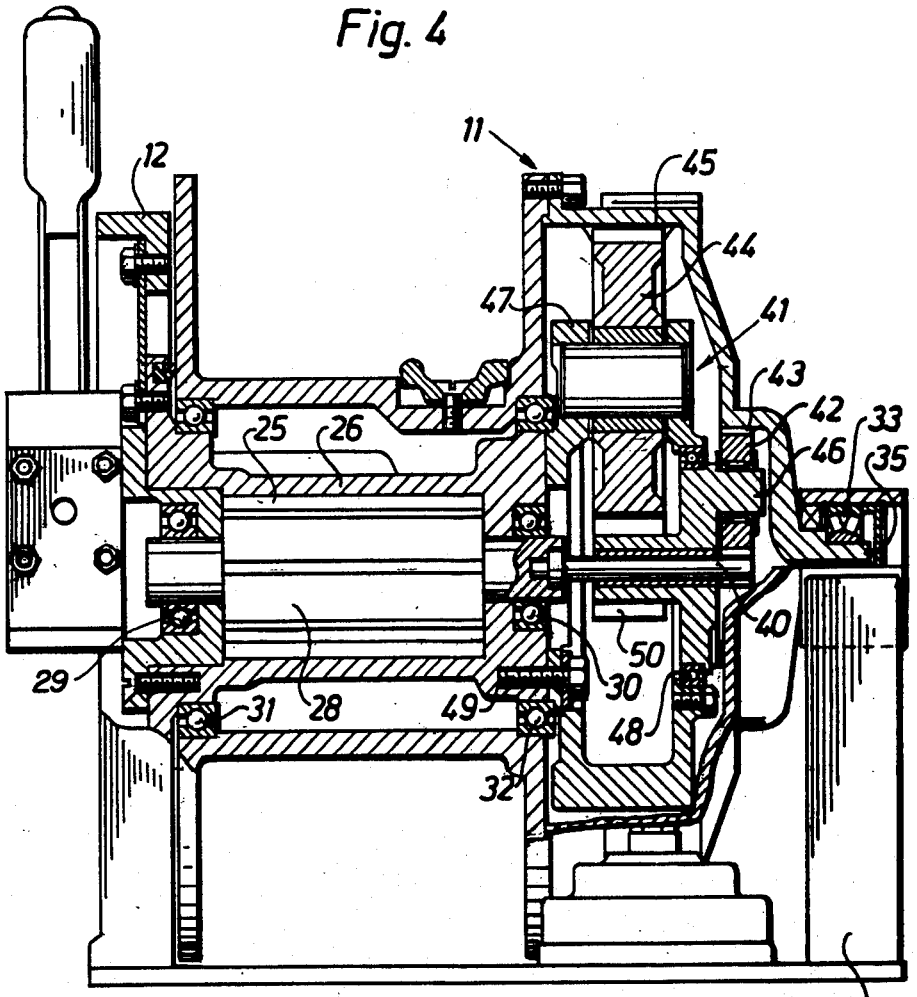
FIG. 4 is a fragmentary cross section taken through the line 4—4 in FIG. 2.

The first stand 12, FIG. 3, includes a frame 55 being mounted to the base portion 14 and a yielding member 56. The yielding member comprises a ring-shaped sheet 56, preferably made of sheet-metal, which is attached to both the frame 55 and the bearing body 26 by bolts 57 and 27 respectively. The sheet 56 is preferably made of common steel with a thickness of about 3–4 mm. The base portion 14 comprises two simple rather thin beams 58 and 59.

Figure 5:
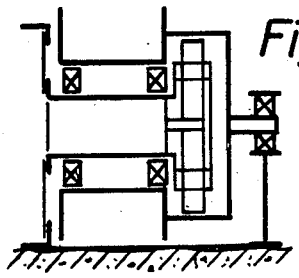
FIG. 5 is a cross section through a winch principally the same as the one in FIG. 1, but schematically shown on a plane surface.
Figure 6:
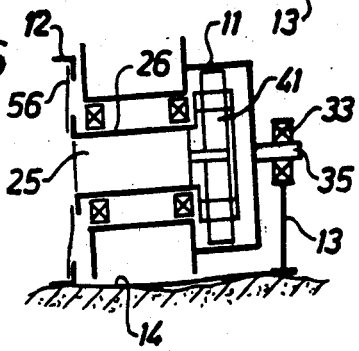
FIG. 6 is the same section as in FIG. 4, but shown on an uneven surface.

The reason for having said sheet 56 will appear from FIGS. 5 and 6. In FIG. 5 the winch is arranged on a foundation which has an even not inclining surface and in FIG. 6 the same winch is shown in a position on an uneven surface. In said last position the second stand 13 is raised in relation to the first stand 12 and the base portion 14 is deformed between said stands 12 and 13. Since the bearing 33 is arranged as a pendulum bearing the bearing, body 26 will act on the sheet 56 with a bending moment. The sheet 56 is designed weak enough to be yieldingly bending moment, thus allowing an inclination between the first stand 12 and the drum unit 11. On the other hand the sheet 56 is strong enough to resist without deformation forces coming from the normal operation of the winch. The mutual positions of the drum unit 11, gear assembly 41 and motor 25 which are subtantially rigidly coupled together will not be changed if the winch is placed on such an uneven surface which means that the gear assembly 41 can be kept from being influenced by the inclination.

Another way of managing the problem of keeping said mutual positions is as already has been mentioned to provide a base structure strong enough not to be deformed by irregularities in the ground. Such a base would, however, make the winch very heavy and expensive. The base 14 according to the present invention is designed mainly for providing a suitable substructure for facilitating the transportation of the winch and is therefore even not always necessary.

Figure 7:
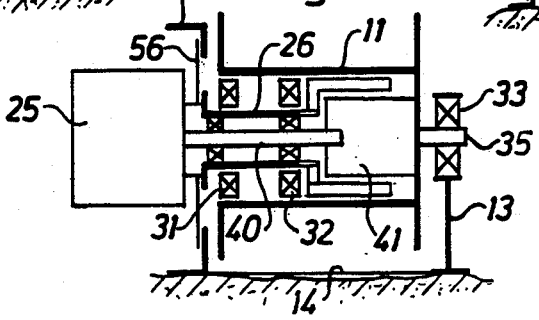
FIG. 7 is a cross section through another embodiment of the winch according to the invention shown in a schematic way.

Another embodiment of the invention is shown in FIG. 7. The motor 25, preferably a piston-type air motor is here arranged on the outside of the drum unit 11 and bearing body 26. The motor 25 is carried by said bearing body 26 and the drive force is transferred to the gear assembly 41 by a drive shaft 40 located within the bearing body 26. The bearings 31 and 32 surrounding the bearing body 26 have a mutual distance wide enough to secure a firm connection between the bearing body 26 and the drum unit 11. The supporting structure 12, 13, and 14 is in principal the same as the one which has been described in connection with the first embodiment. Thus, the structure includes the yielding sheet 56 and the pendulum bearing 33 which makes it unnecessary to prepare for a totally even foundation or for a firm heavy base structure.

It is to be noted that the invention is not limited to the described examples but can be varied in many ways within the scope of the following claims. For example the yielding sheet 56 could be exchanged by one or more spoke-like deformable connections between the bearing body 26 and the frame 55. It is also possible to exclude said frame 55 and instead connect said sheet 56 or spoke-like connections directly to the foundation.

I claim:

1. A winch comprising:

a rotatable drum unit (11) for carrying a load hauling cable wound therearound, said drum unit having a trunnion (35) at one end thereof;

a motor (25);

a gear assembly (41) coupled to said motor and to said drum unit (11) for rotating said drum unit (11), said gear assembly (41) being located in said drum unit (11);

said drum unit (11), motor (25) and gear assembly (41) being substantially rigidly coupled together in fixed mutual alignment;

a supporting structure adapted to be placed on an external support (15), said supporting structure including first and second stands (12, 13) coupled to respective opposite sides of said drum unit (11) for carrying said drum unit (11), said first and second stands being independently tiltable relative to each other and relative to said drum unit (11), such that said drum unit (11), motor (25) and gear assembly (41) are maintained in said fixed mutual alignment irrespective of unevenness of a surface of said external support on which said supporting structure is placed;

said first stand (12) comprising:

a support member (55) adapted to be placed on said external support (15); and yieldable means (56) coupled between said drum unit (11) and said support member (55) for yielding to permit said support member (55) to tilt relative to said drum unit (11); and said second stand (13) comprising a pendulum bearing (33) for cooperation with said trunnion (35) on said drum unit (11) to permit tilting of said second stand (13) relative to said drum unit (11);

thereby maintaining said drum unit, motor and gear assembly in said mutual fixed alignment irrespective of tilting of said first and second stands relative to each other and relative to said drum unit (11).

2. The winch of claim 1, wherein:

said first stand further comprises a hollow bearing body (26) extending into said drum unit (11), said hollow bearing body (26) having axially spaced external bearing means (31, 32) for journalling said drum unit (11) thereon and having means (29, 30, 49) for carrying said motor (25) and at least partly carrying said gear assembly (41); and said yieldable means includes a yielding member (56) coupled between said bearing body (26) and said support member (55) to yieldably couple said drum unit to said support member (55).

3. The winch of claim 2, wherein said support member of said first stand (12) includes an externally supported upstanding frame (55) supported on said external support (15), said yielding member (56) comprising a bendable sheet member fixedly attached to both said frame (55) and said bearing body (26) so as to yieldingly allow an inclination between said frame and bearing body (26).

4. The winch of claim 3, wherein said frame (55) is attached to the periphery of said sheet member (56); and said bearing body (26) is attached to the center of said sheet member (56).

5. The winch of any one of claims 2, 3 or 4, wherein said yielding member (56) comprises a ring-shaped sheet member.

6. The winch of claim 5, wherein said yielding member (56) comprises a metallic ring-shaped sheet member.

7. The winch of any one of claims 2, 3 or 4, wherein said yielding member (56) comprises a metallic sheet member.

8. The winch of claim 2 or 3, wherein said motor (25) is a vane-type air motor having a rotor, said motor being located in said bearing body (26), said bearing body serving as a housing for said rotor of said vane-type air motor.

9. The winch of claims 2 or 3, wherein:

said gear assembly (41) is located at the end of said bearing body (26) and is within said drum unit (11); and said motor (25) is located at the other end of said bearing body (26), said motor having a drive shaft (40) thereon traversing said bearing body (26) for transferring the drive force from said motor (25) to said gear assembly (41) in said drum unit (11).

10. The winch of claim 9, wherein said motor (25) is a piston-type air motor.

11. The winch of claim 1, wherein said supporting structure further comprises a deformable base portion (14) to which said first and second stands are attached, said deformable base portion (41) being adaptable by deformation to possible irregularities of the external support (15).

* * * * *

UNITED STATES PATENT AND TRADEMARK OFFICE

CERTIFICATE OF CORRECTION

PATENT NO. : 4,458,882

DATED : July 10, 1984

INVENTOR(S) : Stefan H.G. Schorling

It is certified that error appears in the above-identified patent and that said Letters Patent is hereby corrected as shown below:

Column 2, line 37, after "motor 25", insert -- , --;

Column 3, line 17, change "to be yieldingly bending moment," to --to be yieldingly deformed by this bending moment,--;

Column 3, line 23, after "together", insert -- , --.

Signed and Sealed this

*Fifth* Day of *March 1985*

[SEAL]

*Attest:*

DONALD J. QUIGG

*Attesting Officer* *Acting Commissioner of Patents and Trademarks*